United States Patent [19]

Wong

[11] Patent Number: 4,512,147

[45] Date of Patent: Apr. 23, 1985

[54] METHOD AND APPARATUS FOR REMOVING CARBON PARTICLES FROM ENGINE EXHAUSTS

[75] Inventor: Victor W. Wong, Cambridge, Mass.

[73] Assignee: Cummins Engine Company, Inc., Columbus, Ind.

[21] Appl. No.: 456,484

[22] Filed: Jan. 7, 1983

[51] Int. Cl.[3] ..... F01N 3/02

[52] U.S. Cl. ..... 60/274; 55/283; 55/312; 55/466; 55/482; 55/485; 55/DIG. 30; 55/DIG. 10

[58] Field of Search ..... 60/274, 288, 311; 55/DIG. 30, 282, 283, 466, DIG. 10, 312, 482, 485

[56] References Cited

U.S. PATENT DOCUMENTS 3,744,249 7/1973 August ..... 60/288
4,335,574 6/1982 Sato ..... 55/312

FOREIGN PATENT DOCUMENTS 2259946 6/1974 Fed. Rep. of Germany ..... 60/288
2845928 5/1979 Fed. Rep. of Germany ..... 60/288

*Primary Examiner*—Douglas Hart
*Attorney, Agent, or Firm*—Neuman, Williams, Anderson & Olson

[57] ABSTRACT

A method for removing particulates from internal combustion exhaust gases in a system which includes a first gas conduit which connects with an engine exhaust pipe and which communicates with a series of trap chambers containing means for filtering or trapping particulate matter present in the exhaust gas. Means for heating gas passing through said first gas conduit is provided upstream of the first trap chamber. A second gas conduit connects with said first gas conduit at a location upstream of the first trap chamber by virtue of which exhaust gas can be made to flow in a path which by-passes any number of trap chambers in the series but which flows through subsequent trap chambers. Valve means are associated with said second gas conduit to selectively by-pass or direct exhaust gas flow through desired trap chambers.

2 Claims, 4 Drawing Figures

METHOD AND APPARATUS FOR REMOVING CARBON PARTICLES FROM ENGINE EXHAUSTS

BACKGROUND OF THE INVENTION

This invention relates to novel methods and apparatus for purifying the exhaust gases emitted from internal combustion engines and more particularly to methods and apparatus for removing particulate emissions from said exhaust gases.

The exhaust gas from internal combustion engines contains finely divided particulate matter which consists largely of carbon particles. The reduction of particulate emissions from the exhaust of internal combustion engines is a matter of considerable importance at the present time. A number of devices or systems have been proposed for this purpose with varying degrees of success. A major desideratum of such devices is that they be capable of undergoing regeneration so as to maintain effectiveness over long periods. Regeneration techniques which involve incinerating the particulate material removed from the exhaust gases require the input of energy sufficient to cause particulate incineration. The input of additional heat energy increases the cost of purifying exhaust gas streams.

OBJECTS OF THE INVENTION

It is a major object of this invention to provide novel methods and apparatus for purifying internal combustion engine exhaust gases.

It is another object of this invention to remove particulates from engine exhaust gases utilizing a system which includes regeneration means.

It is a further object of the invention to provide apparatus for removing particulates from engine exhaust gases which functions effectively for extended periods of time.

A still further object of the invention is to provide methods and apparatus for removing particulates from engine exhaust gases which reduce requirements for additional energy input.

SUMMARY OF THE INVENTION

The present invention involves a method and system or apparatus for removing particulates from internal combustion exhaust gases. The system includes a first gas conduit which connects with an engine exhaust pipe and which communicates with a series of trap chambers containing means for filtering or trapping particulate matter present in the exhaust gas. Means for heating gas passing through said first gas conduit is provided upstream of the first trap chamber. A second gas conduit connects with said first gas conduit at a location upstream of the first trap chamber by virtue of which exhaust gas can be made to flow in a path which bypasses any number of trap chambers in the series but which flows through subsequent trap chambers. Valve means are associated with said second gas conduit to selectively by-pass or direct exhaust gas flow through desired trap chambers.

BRIEF DESCRIPTION OF THE DRAWINGS

The advantages of the invention will be more fully understood from the following description of a preferred embodiment read in conjunction with the accompanying drawings wherein.

DESCRIPTION OF ILLUSTRATED PREFERRED EMBODIMENTS

Figure 1:
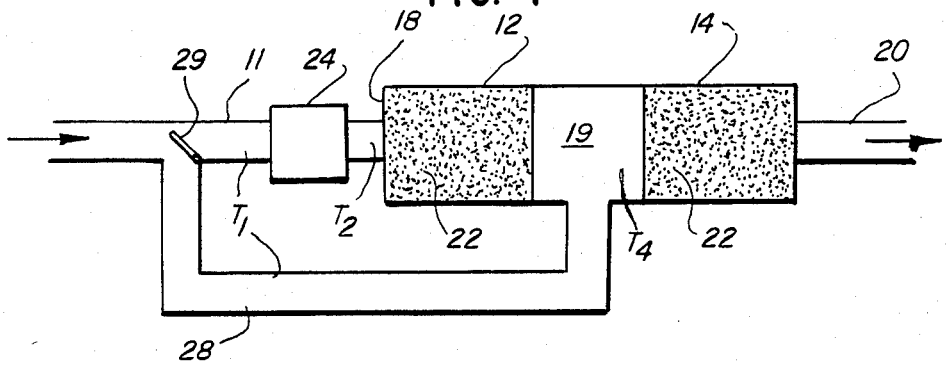
FIG. 1 is a schematic view showing one preferred system according to the invention for purifying exhaust gases emitted from internal combustion engines.
Figure 2:
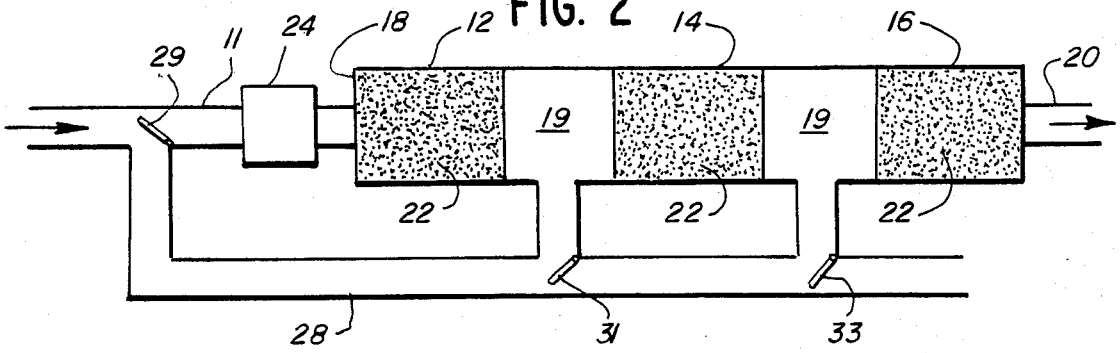
FIG. 2 is a view similar to FIG. 1 illustrating another embodiment of the invention wherein a greater number of particulate trap chambers are employed.
Figure 3:
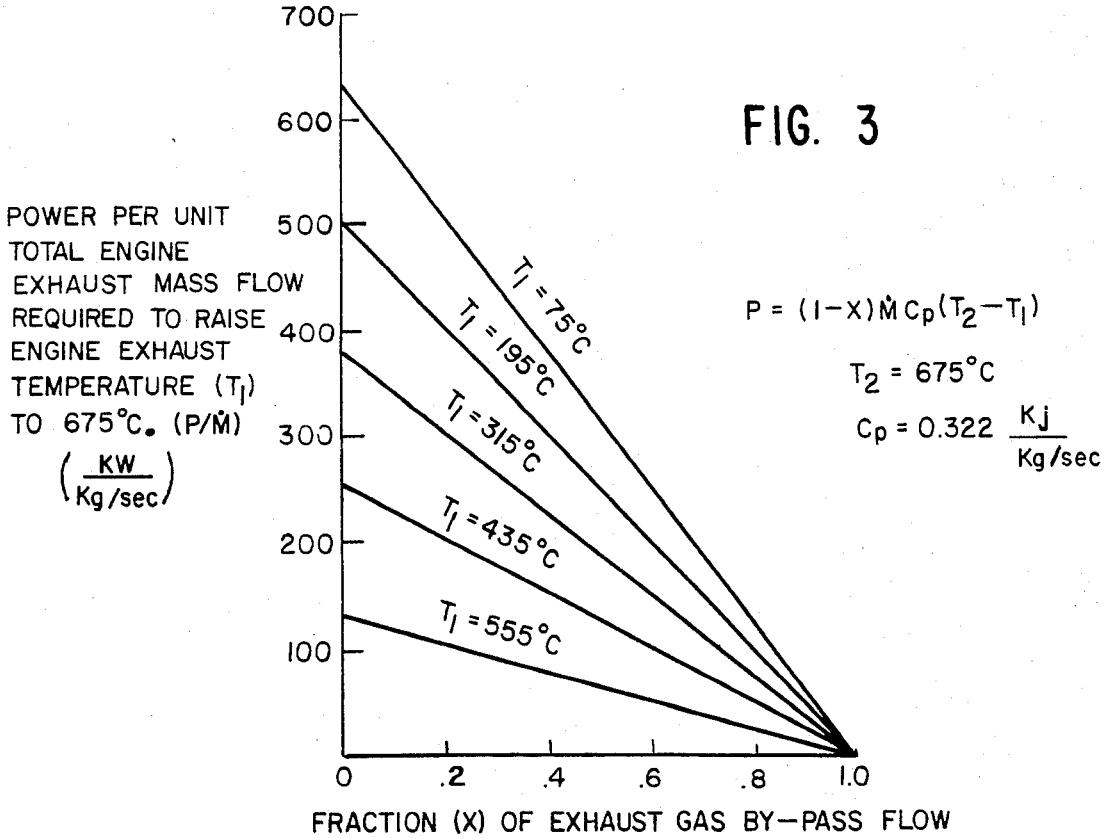
FIG. 3 is a graph illustrating the relationship of external power input requirements with respect to the amount of by-pass exhaust gas flow.

Referring to FIGS. 1 and 2, gas conduit 11 connects with the exhaust pipe (not shown) of a diesel or gasoline combustion engine. Conduit 11 leads to trap chamber or particulate trap 12 which is the first of a series of trap chambers 14 and 16. Two particulate trap chambers 12 and 14 are shown in FIG. 1 and three particulate trap chambers 12, 14 and 16 are shown in FIG. 3. The number of particulate trap chambers arranged in series can be greater as is desired. The particulate trap chambers are enclosed within a housing designated by the numeral 18 with exhaust gas mixing chambers 19 being provided to receive exhaust gas discharged from a previous trap chamber and by-pass gas. Exhaust gas is vented to the atmosphere from the last trap chamber in the series through vent 20. Each of the particulate trap chambers contains a suitable material for filtering or trapping particulate materials such as carbon particles present in the engine exhaust gas. The filtering or trapping material designated by the numeral 22 can be any of the filtering elements known in the art to be useful to collect or trap exhaust gas particulates, including finely divided carbon particles, and which is capable of being subjected to relatively high temperatures sufficient to incinerate or burn off the carbon collected therein. Examples of suitable filtering materials include ceramic beads or monolithic ceramic structures, metal wire mesh screens and the like.

Disposed upstream to the first particulate trap 12 are means designated by numeral 24 for heating exhaust gas flowing through gas flow conduit 11. The heating means 24 can be any suitable heating means for heating the exhaust to relatively high temperatures on the order of 600° C. and above. Examples of such heating means are electric heaters, fuel burners and the like.

By-pass gas conduit 28 communicates with gas conduit 11 at a location upstream of heater 24 and leads to one or more of the exhaust gas chambers 19. In the embodiment of the invention shown in FIG. 1 of the drawings wherein two particulate trap chambers 12 and 14 are employed, by-pass conduit 28 serves to by-pass the first trap chamber 12. In the embodiment of the invention illustrated in FIG. 2 of the drawings, by-pass conduit 28 can be utilized to direct exhaust gases so as to by-pass particulate trap chamber 12 as well as to either completely or partially by-pass the next succeeding trap chamber 14. When a greater number of particulate trap chambers are employed in series, by-pass conduit 28 is appropriately lengthened to permit complete or partial by-pass of each particulate trap chamber in the series. The gas flow through by-pass conduit 28 is controlled by diverter valves 29, 31 and 33. The diverter valves can be switched by conventional manual or automatic control means (not shown).

According to one method of operation, and referring specifically to FIG. 1, when it is desired to purify exhaust gas by removing particulates therefrom, exhaust gas from an internal combustion engine of either the diesel or gasoline type enters conduit 11 and flows to particulate trap chamber 12. At this time diverter valve 29 is positioned to close by-pass conduit 28 so that the entire exhaust gas stream is introduced into trap chamber 12. When the collection of particulates in trap chamber 12 reaches a predetermined point diverter valve 29 is positioned to completely open by-pass conduit 28 and direct the entire exhaust gas stream through gas mixing chamber 19 and into second particulate trap chamber 14.

In an alternative embodiment, diverter valve 29 can be positioned in partially opened position so as to permit flow of exhaust gas through conduit 11 to particulate trap chamber 12 and simultaneously through by-pass conduit 28 to the second particulate trap chamber 14. In this manner exhaust gas purification occurs simultaneously in both particulate trap chambers.

When the particulate trap chambers 12 and 14 become filled with particulates to a predetermined extent so as to restrict passage of exhaust gas therefrom or reduce the efficiency of particulate removal, regeneration of the trap chambers is conducted. For regeneration diverter valve 29 is positioned to partially close conduit 11 and to cause a portion of the exhaust gas stream to flow through by-pass conduit 28 so as to by-pass particulate trap chamber 12. At this time heater 24 is activated to heat that portion of the exhaust gas stream passing through conduit 11 to a temperature sufficient to effect incineration or burning of the particulate matter trapped in chamber 12. Generally, temperatures on the order of above 600° C. are sufficient for this purpose. The exothermic combustion of the particulate matter in the trap chamber 12 further increases the temperature of the combustion gases which are discharged from trap chamber 12 into exhaust gas mixing chamber 19 where they mix with the unheated exhaust gas stream flowing through by-pass conduit 28. The combined gas mixture then passes through trap chamber 14 and finally is vented to the atmosphere through vent 20. The temperature of the gas streams combined in chamber 19 and which pass into the second trap chamber 14 depends on the particulate burning rate in trap chamber 12 and the energy input from heater 24 as well as the amount of exhaust gas by-pass flow in conduit 28. The by-pass flow in conduit 28 is adjusted to result in the combustion gas mixture entering trap chamber 14 having a temperature, say about 675° C., sufficient for particulate regeneration in trap chamber 14. When regeneration of the particulate trap chambers 12 and 14 is achieved, the regeneration cycle can be stopped and the exhaust gas purifying cycle repeated as described.

When more than two particulate trap chambers are employed in series such as illustrated in FIG. 2 wherein three trap chambers 12, 14 and 16 are aligned in series, the exhaust gas purifying and regeneration cycles are conducted in similar manner.

In accordance with this invention, periodic regeneration of the exhaust gas purifying system is accomplished with reduced requirements for input of energy (heat). Thus, only a portion of the entire engine exhaust stream need be heated for regeneration purposes and heat generated from the exothermic particulate combustion in one particulate trap chamber is effectively utilized to regenerate succeeding particulate trap chambers in the series. Regeneration of a particulate trap chamber serves to supply heat energy for ignition and incineration of carbon particles in succeeding particulate trap chambers.

With the apparatus of this invention, the energy required for regeneration is related to the amount of by-pass exhaust gas flow. This relationship is graphically illustrated in FIG. 3 of the drawings, with the power requirement being calculated by the formula:

$$P=(1-X)\dot{M}\,C_p(T_2-T_1)$$

where $P$ = Power Requirement (Kilowatt)

$X$ = Fraction of engine exhaust gas flowing through by-pass conduit so as to by-pass the first particulate trap chamber 12.

$\dot{M}$ = Total engine exhaust gas flow (Kilogram/sec.)

$C_p$ = Specific heat of exhaust gas at constant pressure $$\left(\frac{\text{Kilojoule}}{\text{Kilogram °K.}}\right)$$

$T_2$ = temperature of engine exhaust gas after leaving the heater (°C.)

$T_1$ = Temperature of engine exhaust gas entering the purifying system (°C.)

Figure 4:
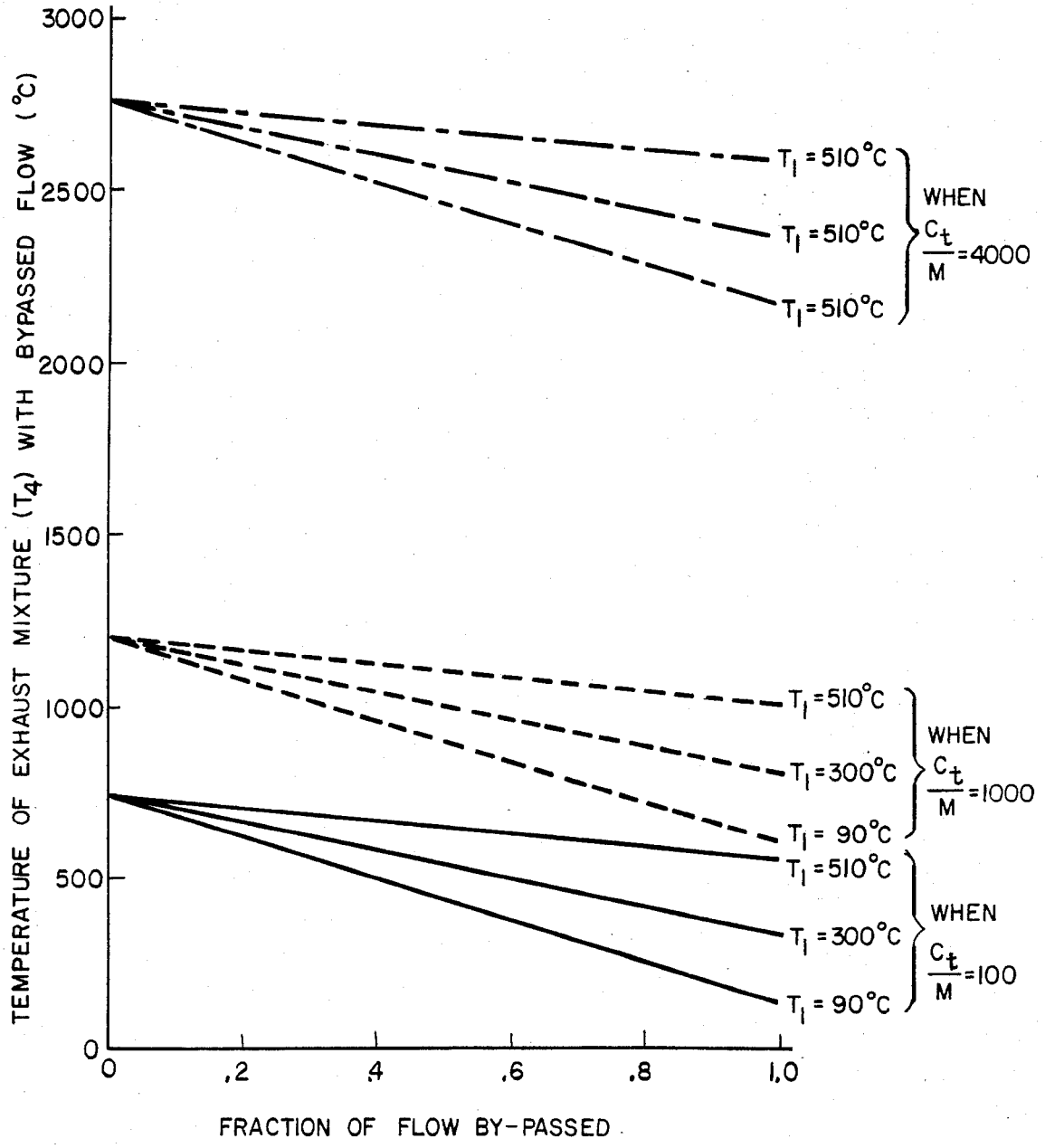
FIG. 4 is a graph illustrating the effect of by-pass gas flow with respect to temperature reduction in the system.

Also, by virtue of a portion of the engine exhaust gas being directed for regeneration purposes through by-pass conduit 28, thus by-passing the first particulate trap chamber 12, the likelihood of causing excessive heating in the following particulate trap chamber 14 is reduced even though burning of the particulate carbon in the trap chamber 12 is an exothermic reaction which produces heat. The relationship of the amount of exhaust gas by-pass flow and temperatures at various locations in the purifying system (the temperatures at various locations being indicated in FIG. 1 by $T_1$, $T_2$ etc.) is illustrated in FIG. 4 of the drawings using the following formula:

$$T_4=X(T_1-T_2)+T_2+0.522\,\dot{C}_t/\dot{M}$$

where $T_4$ = temperature of exhaust gas mixture entering the second particulate trap chamber 14 (°C.)

$X$ = Fraction of engine exhaust gas flowing through by-pass conduit so as to by-pass the first particulate trap chamber 12

$T_1$ = temperature of engine exhaust gas entering the purifying system (°C.)

$T_2$ = 675° C. = temperature of engine exhaust gas after leaving the heater $\dot{C}_t$ = particulate carbon burning rate (Gram/min.)

$\dot{M}$ = total engine exhaust gas flow (Kilogram/sec.).

The advantages of the invention are apparent from the foregoing. Regeneration of the purifying system is effectively accomplished while reducing power requirements. By controlling the amount of by-pass flow, the overall restriction and particulate removal efficiency of the system can be varied. Maximum pressure drop and particulate removal efficiency occurs when the entire exhaust gas flow passes through the first particulate trap. By means of the described system the risk of excessive heating during regeneration of any particulate trap chamber is minimized.

Those modifications and equivalents which fall within the spirit of the invention are to be considered a part thereof.

What is claimed is:

1. Apparatus for removal of particulates from exhaust gas emitted by an internal combustion engine which comprises a first gas flow conduit leading to the exhaust of an internal combustion engine and to a first particulate trapping chamber containing means for removing particulates from exhaust gas, at least two additional particulate trapping chambers containing means for removing particulates from exhaust gas, gas mixing chambers disposed between each of the said particulate trapping chambers, means for heating gas flowing in said first gas flow conduit at a location upstream of said first particulate trapping chamber, a second gas flow conduit connecting with said first gas flow conduit at a location upstream of said heating means and leading to said gas mixing chambers, and low direting means for selectively directing flow through said first and second gas flow conduits.

2. A method for removing particulate matter from the exhaust gas of an internal combustion engine which comprises flowing said exhaust gas into a series of particulates, trapping chambers containing means for removing particulates, periodically regenerating the said particulate trapping chambers by diverting a poriton of the flow of exhaust gas so as to by-pass one or more of said trapping chambers, heating a poriton of the exhaust gas entering a trapping chamber to a temperature sufficient to incinerate trapped particles therein and regenerate said chamber, mixing the heated exhaust gas discharged from said regenerated chamber with the by-pass exhaust gas flow and introducing the mixture of said gases into a second particulate trapping chamber at a temperature sufficient to incinerate trapped particles therein and regenerate said chamber.

* * * * *

UNITED STATES PATENT AND TRADEMARK OFFICE

CERTIFICATE OF CORRECTION

PATENT NO. : 4,512,147

DATED : April 23, 1985

INVENTOR(S) : Victor W. Wong

It is certified that error appears in the above-identified patent and that said Letters Patent are hereby corrected as shown below:

Column 3, lines 49-53 should read as follows:

"cuit 28. The by-pass flow in conduit 28 is adjusted to result in the combined gas mixture entering trap chamber 14 having a temperature, say about 675° C., sufficient for particulate incineration in trap chamber 14. When regeneration of the particulate trap chamber 12"

Column 6, line 1, "low directing" should be -- flow directing -- line 7, "ticulates," should be -- ticulate --

Signed and Sealed this

*Twentieth* Day of *August 1985*

[SEAL]

*Attest:*

DONALD J. QUIGG

*Attesting Officer* *Acting Commissioner of Patents and Trademarks*